US010108121B2

(12) United States Patent
Takahashi

(10) Patent No.: US 10,108,121 B2
(45) Date of Patent: Oct. 23, 2018

(54) IMAGE FORMING APPARATUS AND FIXING DEVICE

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Kazutoshi Takahashi, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/466,062

(22) Filed: Mar. 22, 2017

(65) Prior Publication Data

US 2018/0224781 A1 Aug. 9, 2018

(30) Foreign Application Priority Data

Feb. 6, 2017 (JP) ..... 2017-019398

(51) Int. Cl.
*G03G 15/20* (2006.01)

(52) U.S. Cl.
CPC ..... *G03G 15/2089* (2013.01)

(58) Field of Classification Search
CPC ..... G03G 15/2032; G03G 15/2067; G03G 15/2035; G03G 15/2071; G03G 21/1821; G03G 15/0136; G03G 2215/0193
See application file for complete search history.

(56) References Cited

U.S. PATENT DOCUMENTS 5,289,248 A * 2/1994 Kurokawa ..... G03G 15/2032 219/216
8,843,045 B2 9/2014 Ishikawa et al.
2006/0002737 A1* 1/2006 Shinshi ..... G03G 15/2035 399/122
2011/0097093 A1* 4/2011 Birumachi ..... G03G 15/2064 399/21

(Continued)

FOREIGN PATENT DOCUMENTS

JP 2006048005 A * 2/2006 ..... G03G 15/2035
JP 2009145417 A * 7/2009 ..... G03G 15/2035

(Continued)

*Primary Examiner* — Sevan A Aydin
(74) *Attorney, Agent, or Firm* — Amin, Turocy & Watson LLP

(57) ABSTRACT

A first supporting member which rotatably supports a first rotator, a second supporting member which rotatably supports a second rotator, a bracket which is mounted in the second supporting member distant from the fastening portion of the first supporting member, an urging portion which is disposed between a fastening portion and the bracket, and urges the first rotator and the second rotator so as to be pulled to each other. The bracket is formed with a hooking portion on one end side of the main body portion and a hole where an inserting member can be inserted in an oblique direction from the other end side of the main body portion toward the hooking portion, the second supporting member includes a positioning member which supports the hooking portion of the bracket and regulates movement of the other end side of the bracket on which the urging portion is mounted.

7 Claims, 7 Drawing Sheets

(56) References Cited

U.S. PATENT DOCUMENTS

| | | | | |
|---|---|---|---|---|
| 2011/0318040 | A1* | 12/2011 | Kanno | G03G 15/2039 399/69 |
| 2012/0237229 | A1* | 9/2012 | Okamoto | G03G 15/2032 399/33 |
| 2013/0004218 | A1* | 1/2013 | Tsueda | G03G 15/206 399/329 |
| 2013/0071153 | A1* | 3/2013 | Oomoto | G03G 15/2032 399/329 |
| 2013/0084088 | A1* | 4/2013 | Sakai | G03G 15/2064 399/45 |
| 2013/0272756 | A1* | 10/2013 | Nagata | G03G 15/2085 399/323 |
| 2015/0030345 | A1* | 1/2015 | Murakami | G03G 15/2039 399/69 |
| 2015/0063836 | A1* | 3/2015 | Wu | G03G 15/2039 399/21 |
| 2015/0110532 | A1* | 4/2015 | Takeuchi | G03G 15/2032 399/329 |
| 2015/0261150 | A1* | 9/2015 | Hasegawa | G03G 15/2039 399/69 |
| 2015/0338807 | A1* | 11/2015 | Tanaka | G03G 15/2085 399/122 |
| 2016/0320731 | A1* | 11/2016 | Kitagawa | G03G 15/2032 |
| 2017/0205743 | A1* | 7/2017 | Kamiya | G03G 15/2053 |

FOREIGN PATENT DOCUMENTS

| | | | | | |
|---|---|---|---|---|---|
| JP | 2015081976 | A | * | 4/2015 | G03G 15/2064 |
| JP | 2015141263 | A | * | 8/2015 | G03G 15/2064 |
| JP | 2016173435 | A | * | 9/2016 | G03G 15/2032 |
| JP | 2016177024 | A | * | 10/2016 | G03G 15/2017 |

* cited by examiner

| SCREWDRIVER | SCREW | DIMENSION OF TIP END OF DRIVER | DIMENSION OF LONG HOLE (ø) |
|---|---|---|---|
| NO. 1 | M2～M2. 6 | 4. 8mm～5. 4mm | 4.8 mm OR MORE |
| NO. 2 | M3～M5 | 5. 8mm～6. 4mm | 5.8 mm OR MORE |
| NO. 3 | M6～M8 | 7. 8mm～8. 4mm | 7.8 mm OR MORE |
| NO. 4 | M8～ | 8. 8mm～9. 4mm | 8.8 mm OR MORE |

IMAGE FORMING APPARATUS AND FIXING DEVICE

CROSS-REFERENCE TO RELATED APPLICATION

This application is based upon and claims the benefit of priority from Japanese Patent Application No. 2017-019398, filed Feb. 6, 2017, the entire contents of which are incorporated herein by reference.

FIELD

Embodiments described herein relate generally to an image forming apparatus which forms an image on a recording medium using a fixing device, and to the fixing device which fixes a toner image to the recording medium such as paper.

BACKGROUND

In the related art, an image forming apparatus forming an image on a recording medium (for example, paper), which is an object to be printed, is known. The image forming apparatus transfers a toner image to paper which is supplied to a transferring portion. The fixing device heats and pressurizes the paper to which the toner image is transferred, and the toner image is fixed to the paper.

The fixing device includes, for example, a heating roller and a pressurizing roller, the paper to which a toner is attached passes through a nipped part of the heating roller and the pressurizing roller, and thus the toner is fixed to the paper by heat and pressure.

However, the heating roller and the pressurizing roller are assembled so as to be strongly pulled to each other using a coil spring having strong tension. Generally, when the coil spring is mounted on a fixer, one end thereof is hooked on a hook, or the like while the coil spring is pulled by hand. However, if a tension of the coil spring is strong, it is necessary that one end is required to be hooked on the hook while the coil spring is pulled, and thus the coil spring is not easy to be mounted. Therefore, there is a problem in that workability is reduced.

DETAILED DESCRIPTION

An object of the exemplary embodiment is to provide an image forming apparatus which is capable of simply mounting a bracket.

In general, according to one embodiment, the image forming apparatus includes a first rotator, a second rotator that faces the first rotator, a first supporting member that rotatably supports the first rotator, a second supporting member that rotatably supports the second rotator, a bracket that is mounted in the second supporting member distant from a fastening portion of the first supporting member, includes a main body portion and a hooking portion formed on one end side of the main body portion, and is formed with a hole to which an inserting member is able to be inserted in an oblique direction from the other end side of the main body portion toward the hooking portion, an urging portion that is disposed between the fastening portion and the bracket, and urges the first rotator and the second rotator so as to be pulled to each other, and a positioning member that is formed in the second supporting member, supports the hooking portion of the bracket, and regulates movement of the other end side of the bracket on which the urging portion is mounted.

Hereinafter, the embodiments for carrying out the invention will be described with reference to drawings. Also, the same numeral is given to the same part in each drawing.

First Embodiment

Figure 1:
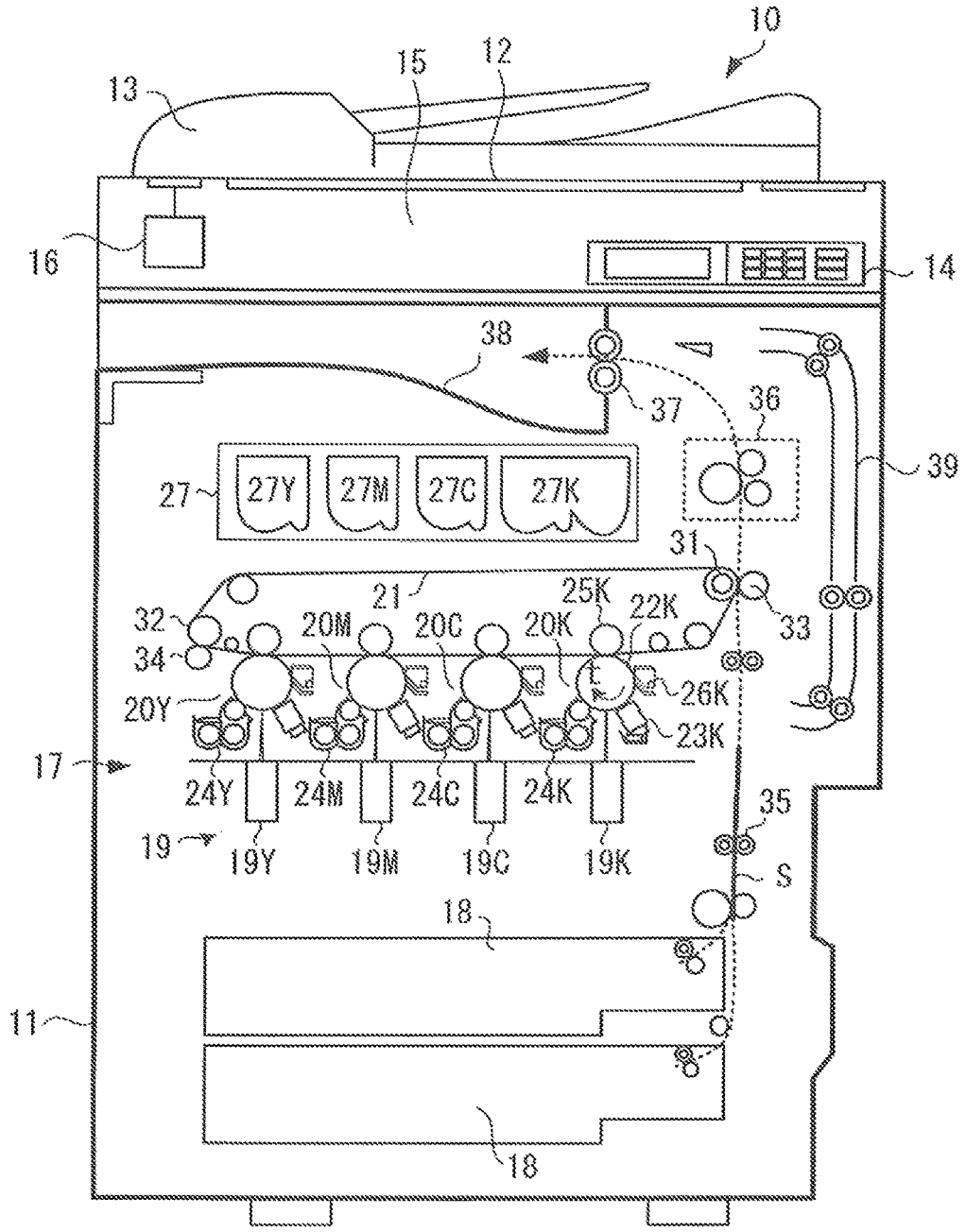
FIG. 1 is a configuration view illustrating an image forming apparatus according to an embodiment.

FIG. 1 is a configuration view illustrating an image forming apparatus according to an embodiment. In FIG. 1, an image forming apparatus 10 is, for example, multifunction peripherals (MFP) which are a complex machine, a printer, or a copy machine. The MFP is exemplified hereinafter.

An original document platen 12 which is a transparent glass is on a main body 11 of the MFP 10. An automatic original document feeder (ADF) 13 is openably provided on the original document platen 12. In addition, an operation panel 14 is provided on the main body 11. The operation panel 14 includes various keys and a displaying portion of a touch panel manner.

A scanner portion 15 which is an image reading portion is provided under the ADF 13 in the main body 11. The scanner portion 15 generates image data by reading an original document transported by the ADF 13 or an original document mounted on the original document platen. The scanner portion 15 is provided with an image sensor 16. The image sensor 16 is disposed in a main scanning direction (depth direction in FIG. 1).

Further, a printer portion 17 constituting an image forming portion is provided on the center inside the main body 11. A plurality of cassettes 18 accommodating paper having various sizes are provided under the main body 11. The printer portion 17 includes a photoconductive drum, an exposing portion, and the like. The exposing portion includes a scanning head 19 having an LED which is a light emitting element. The printer portion 17 generates an image by scanning the photoconductive drum in the main scanning direction with a light beam from the scanning head 19.

The printer portion 17 forms an image on a recording medium, which is an object to be printed, by processing image data read using the scanner portion 15 or image data generated using a personal computer (PC), or the like. In a description hereinafter, a case in which a paper S is used as the recording medium will be exemplified, but an OHP sheet, and the like can be used as the recording medium.

The printer portion 17 is a color laser printer using, for example, a tandem method. The printer portion 17 includes image forming stations 20Y, 20M, 20C, and 20K of each color of yellow (Y), magenta (M), cyan (C), and black (K). The image forming stations 20Y, 20M, 20C, and 20K are disposed in parallel from an upstream along a downstream side under an intermediate transferring belt 21. In addition, the scanning head 19 is also provided with a plurality of scanning heads 19Y, 19M, 19C, and 19K in the main scanning direction corresponding to the image forming stations 20Y, 20M, 20C, and 20K.

The image forming stations 20Y, 20M, 20C, and 20K have the same configuration. Therefore, the image forming station 20K will be described as a representative. The image forming station 20K includes a photoconductive drum 22K which is an image carrier. Around the photoconductive drum 22K, an electric charger 23K, a developing device 24K, a primary transferring roller 25K, a cleaner 26K, and the like are disposed along a rotation direction t of the photoconductive drum 22K. An exposure position of the photoconductive drum 22K is irradiated with light from the scanning head 19K, and electrostatic latent image is carried onto the photoconductive drum 22K.

The electric charger 23K uniformly charges the entirety of a surface of the photoconductive drum 22K. The developing device 24K supplies a two-component developer, which includes a black toner and a carrier, to the photoconductive drum 22K by a developing roller to which a developing bias is applied. The toner image is formed on the photoconductive drum 22K. The cleaner 26K removes a remained toner on the surface of the photoconductive drum 22K.

In addition, a toner cartridge 27, which supplies toners to developing devices 24Y to 24K, is provided on the image forming stations 20Y to 20K. The toner cartridge 27 includes toner cartridges 27Y, 27M, 27C, and 27K of each color of yellow (Y), magenta (M), cyan (C), and black (K).

The intermediate transferring belt 21 is stretched to a driving roller 31 and a driven roller 32 and is cyclically moved. Also, the intermediate transferring belt 21 faces in contact with the photoconductive drum 22K. The primary transferring roller 25K is provided at a position facing the photoconductive drum 22K of the intermediate transferring belt 21. A primary transfer voltage is applied to the intermediate transferring belt 21 by the primary transferring roller 25K, and the toner image on the photoconductive drum 22K is primarily transferred to the intermediate transferring belt 21.

A secondary transferring roller 33 is disposed to face the driving roller 31 stretching the intermediate transferring belt 21. When the paper S passes between the driving roller 31 and the secondary transferring roller 33, a secondary transferring voltage is applied to the paper S by the secondary transferring roller 33. Also, the toner image on the intermediate transferring belt 21 is secondarily transferred to the paper S. A belt cleaner 34 is provided on the vicinity of the driven roller 32 of the intermediate transferring belt 21.

In addition, the scanning head 19K functions as an exposing portion facing the photoconductive drum 22K. The photoconductive drum 22K rotates at a rotation speed which is set in advance, and stores charges in a surface thereof. The electrostatic latent image is formed on the surface of the photoconductive drum 22K by irradiating and exposing the photoconductive drum 22K with light from the scanning head 19K. Also, the scanning heads 19Y, 19M, and 19C form an electrostatic latent image on surfaces of the photoconductive drums of the corresponding image forming stations 20Y, 20M, and 20C in the same manner.

As the exposing portion of the photoconductive drum 22, instead of the scanning head 19, a laser exposure device may be used. The laser exposure device performs scanning by applying a laser beam emitted from a semiconductor laser element in the main scanning direction of the photoconductive drums 22K to 22C using a polygon mirror.

As illustrated in FIG. 1, a transportation roller 35 is provided from a supplying cassette 18 through the secondary transferring roller 33. The transportation roller 35 transports the paper S which is taken out from an inside of the supplying cassette 18. Further, a fixing device 36 is provided on a downstream of the secondary transferring roller 33. The fixing device 36 constitutes a part of an image forming portion.

The paper S transported to the fixing device 36 is heated and pressurized by the fixing device 36, and thus the image is fixed to the paper S. The fixing device 36 will be described in detail, but a fixing belt, a heating roller, and a pressurizing roller are included therein. The paper S to which the image is fixed is discharged to a discharging tray 38 through a pair of paper discharge rollers 37.

Further, a reverse transporting passage 39 is provided on a downstream of the fixing device 36. Once the paper S is transported in a direction of a paper discharging tray 38 and the paper discharge rollers 37 are reversely rotated, the paper S is transported to the reverse transporting passage 39 by being switched back. The reverse transporting passage 39 reverses the paper S and guides the paper in a direction of the secondary transferring roller 33. The reverse transporting passage 39 is used at the time of double-side printing.

The printer portion of the image forming apparatus 10 is not limited to a tandem method, and other methods may be used. Also, the number of the developing devices 24 is not limited to four.

Figure 2:
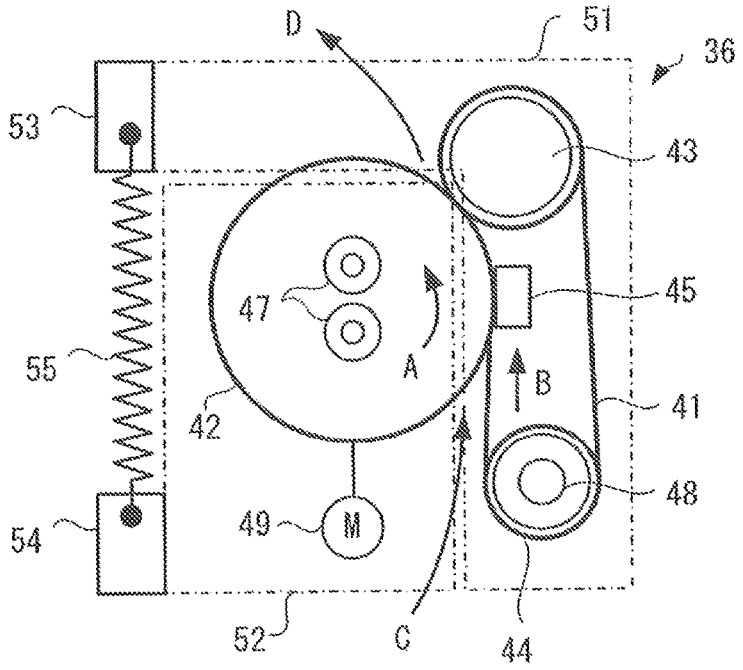
FIG. 2 is a schematic configuration view illustrating a fixing device in the image forming apparatus when seen from a side.

Next, with reference to FIG. 2 to FIG. 4, the fixing device 36 according to the embodiment will be described. FIG. 2 is a schematic configuration view of the fixing device 36 when seen from a side. As illustrated in FIG. 2, the fixing device 36 includes a fixing belt 41, a heating roller 42, a pressurizing roller 43, and an auxiliary roller 44.

The fixing belt 41 is an endless belt, and is stretched to the pressurizing roller 43 and the auxiliary roller 44, and the fixing belt 41 is wound around a part of the heating roller 42. The heating roller 42 is a cylindrical shape, and is made of, for example, a metal such as aluminum and iron. A surface of the heating roller 42 is coated to have a good releasability, so that the toner is not easy to be attached. The heating roller 42 includes a shaft on both ends thereof, and both ends of the shaft are maintained by bearings.

The pressurizing roller 43 pressurizes the paper S to the heating roller 42 side, and fixes a toner to the paper S. The pressurizing roller 43 has a metal shaft with rubber wound around thereof. The auxiliary roller 44 is constituted by a hollow roller for heating the fixing belt 41, and is made of, for example, a metal such as aluminum and iron. The auxiliary roller 44 is disposed on a side to which the paper S is sent.

The fixing device 36 includes a pad member 45 which is disposed inside the fixing belt 41, a halogen ramp 47 for heating disposed inside the heating roller 42, and a halogen ramp 48 disposed inside the auxiliary roller 44.

The pressurizing roller 43 presses the fixing belt 41 pinched between the heating roller 42 and the pressurizing roller with a predetermined weighting. The fixing belt 41 and the heating roller 42 are in contact with a fixing nipping portion. The toner on the paper S is fixed to the paper S by heat and pressure when the paper S passes through the fixing nipping portion.

The heating roller 42 is rotated when a driving force is transmitted thereto by a motor 49. The fixing belt 41, the pressurizing roller 43, and the auxiliary roller 44 are rotated and driven in accordance with rotation of the heating roller 42. Also, the fixing belt 41 may be driven itself.

The fixing belt 41 is pressed on the heating roller 42 using the pad member 45. The heating roller 42 is heated by radiation heat from an inside thereof by the halogen ramp 47 disposed inside the roller. The auxiliary roller 44 heats the fixing belt 41 by the halogen ramp 48 disposed inside the roller.

For example, if the heating roller 42 is rotated in an arrow A direction of FIG. 2, the fixing belt 41 is rotated in an arrow B direction. Also, the paper S is pinched by a nipping portion between the fixing belt 41 and the heating roller 42, the paper S is transported in an arrow C direction, and discharged in an arrow D direction. Therefore, when the paper S passes through the nipping portion, the toner is melted by applying heat and pressure to the paper S, and the toner image is fixed to the paper S.

The fixing belt 41, the pressurizing roller 43, and the auxiliary roller 44 constitute the first rotator, and are mounted in a first supporting member 51. The heating roller 42 constitutes a second rotator, and is mounted in a second supporting member 52. In addition, an urging portion 55 is mounted between an arm 53 provided in the first supporting member 51 and a bracket 54 mounted in the second supporting member 52. As the urging portion 55, for example, a tension coil spring (helical extension spring) can be used. The tension coil spring 55 as the urging portion is simply referred to as a spring 55 hereinafter.

The arm 53 constitutes a fastening portion for mounting one end of the spring 55. The heating roller 42, and the fixing belt 41 and the pressurizing roller 43 are urged so as to be pulled to each other by the spring 55, and the heating roller 42 and the fixing belt 41 constitute the nipping portion.

However, the heating roller 42, and the fixing belt 41 and the pressurizing roller 43 are assembled so as to be strongly pulled to each other using the spring 55 having a strong tension. Since the tension of the spring 55 is strong, the spring 55 needs to be hooked to the hook while the spring is pulled by hand, and the like, and the spring 55 is difficult to be mounted. In the embodiment, the image forming apparatus capable of simply mounting the spring 55 in the fixing device is provided.

Figure 3:
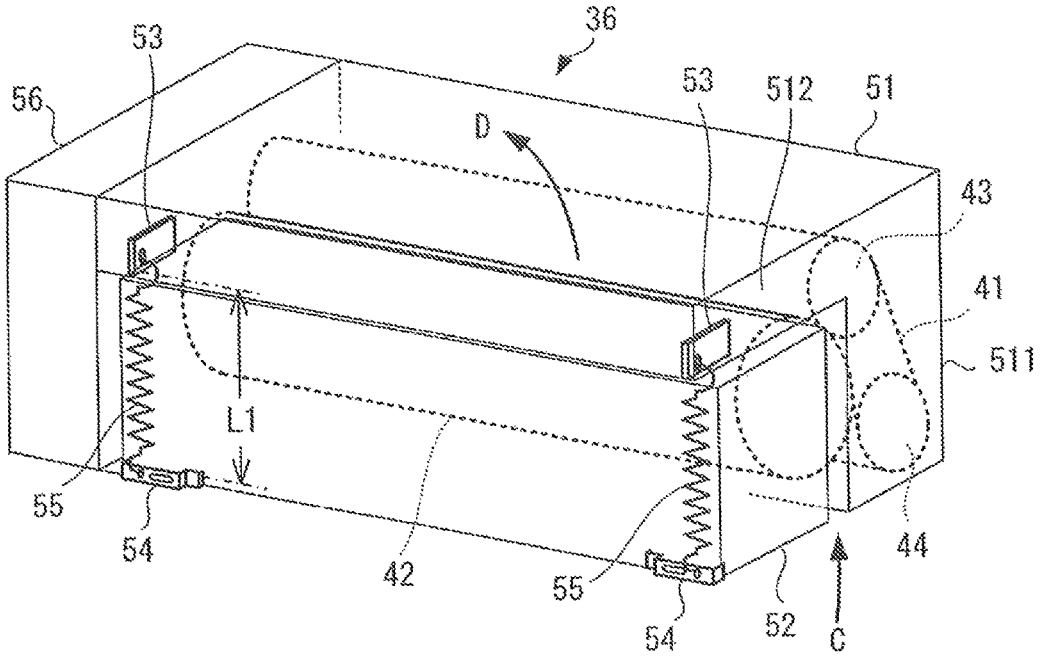
FIG. 3 is a configuration view schematically illustrating the fixing device.

FIG. 3 is a configuration view schematically illustrating the fixing device 36. In FIG. 3, the fixing device 36 includes the fixing belt 41 which is the first rotator, the first supporting member 51 rotatably supporting the pressurizing roller 43 and the auxiliary roller 44, and the second supporting member 52 rotatably supporting the heating roller 42 which is the second rotator. The first supporting member 51 and the second supporting member 52 are disposed in parallel to the main scanning direction (longitudinal direction).

The first supporting member 51 is schematically formed in an L shape, and the fixing belt 41, and the pressurizing roller 43 and the auxiliary roller 44 are mounted in a longitudinal direction inside the first supporting member 51. The second supporting member 52 is schematically formed in a rectangular shape, and a heating roller 421 is mounted in the longitudinal direction inside the second supporting member 52.

In FIG. 3, the paper S is sent from an end portion 511 of the first supporting member 51 (arrow C direction), and is discharged from the top of the first supporting member 51 (arrow D direction). Also, an end portion 512 of the first supporting member 51 extends so as to cover an upper portion of the second supporting member 52, and is entirely formed in an L shape.

In addition, the arms 53 are respectively provided as a fastening portion in both ends of the end portion 512 of the first supporting member 51. Further, the brackets 54 facing the arm 53 can be respectively provided in the both end portions under the second supporting member 52.

The first supporting member 51 and the second supporting member 52 are pulled to each other by mounting the spring 55 having strong tension between the arm 53 and the bracket 54. That is, the heating roller 42, and the fixing belt 41 and the pressurizing roller 43 are urged so as to be strongly pulled to each other by the spring 55. Also, a distance between the arm 53 and the bracket 54 is set to a distance L1, which is set in advance according to tension of the spring 55, and the like.

In addition, a third supporting member 56 for mounting a driving portion is provided at one end portion of the first supporting member 51 and the second supporting member 52 in the longitudinal direction. The driving portion provided in the third supporting member 56 includes a power supply circuit which supplies power to the motor 49 for rotating the heating roller 42, the halogen ramps 47 and 48, and the like.

Figure 4:
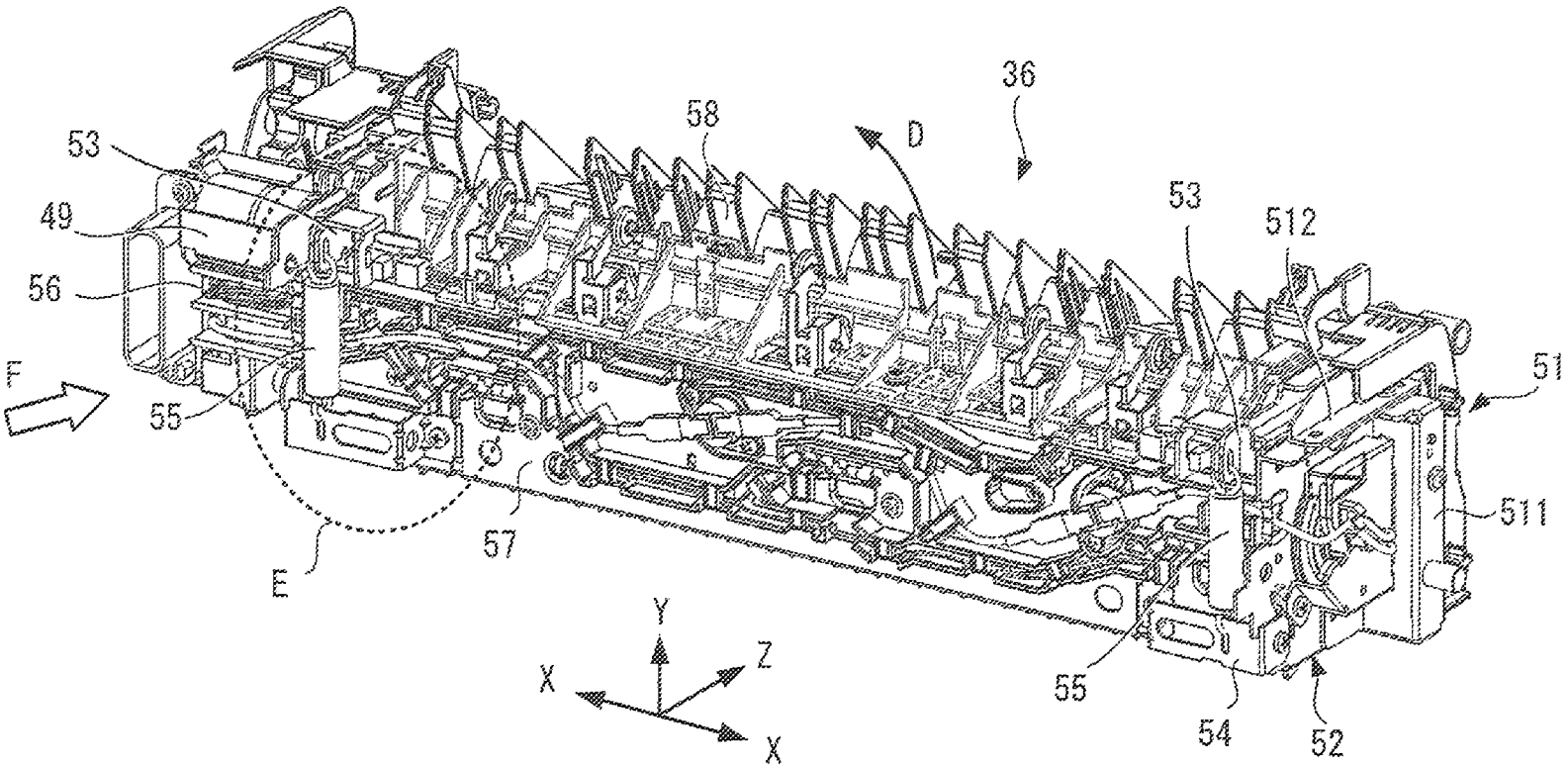
FIG. 4 is a perspective view illustrating a specific configuration of the fixing device in the embodiment.

FIG. 4 is a perspective view illustrating a specific configuration of the fixing device 36. In FIG. 4, the fixing belt 41, and the pressurizing roller 43 and the auxiliary roller 44 are mounted inside the first supporting member 51, and the heating roller 42 is mounted inside the second supporting member 52. FIG. 4 illustrates an exterior of the fixing device 36, and does not illustrate the fixing belt 41, the heating roller 42, the pressurizing roller 43, and the auxiliary roller 44 because these are hidden.

The arms 53 which are fastening portions are respectively provided in both ends of the longitudinal direction of the end portion 512 of the first supporting member 51, and the brackets 54 facing the arms 53 are respectively mounted under the both end portions of the second supporting member 52 in the longitudinal direction.

The bracket 54 is a sheet metal component, and is mounted in a frame 57 constituting the second supporting member 52. In addition, the spring 55 having strong tension is mounted between the arm 53 and the bracket 54 so that the first supporting member 51 and the second supporting member 52 are pulled to each other. A mounting method of the bracket 54 in the frame 57, and a mounting method of the spring 55 between the arm 53 and the bracket 54 will be described later.

Various components constituting the driving portion including the motor 49 are mounted in the third supporting member 56. Further, a plurality of guide members 58 are mounted on the top of the first supporting member 51 along the longitudinal direction of the first supporting member 51. The guide member 58 serves as a guide at the time of discharging the paper S in the arrow D direction.

In FIG. 4, when the longitudinal direction of the first supporting member 51 and the second supporting member 52 is set to X, a height direction is referred to as Y, and a depth direction is referred to as Z. Also in drawings hereinafter, a longitudinal direction is referred to as X, a height direction is referred to as Y, and a depth direction is referred to as Z in the same manner.

Next, with reference to FIG. 5 and FIG. 6, structures of the arm 53 and the bracket 54 for mounting the spring 55, and a structure of the frame 57 will be described.

Figure 5:
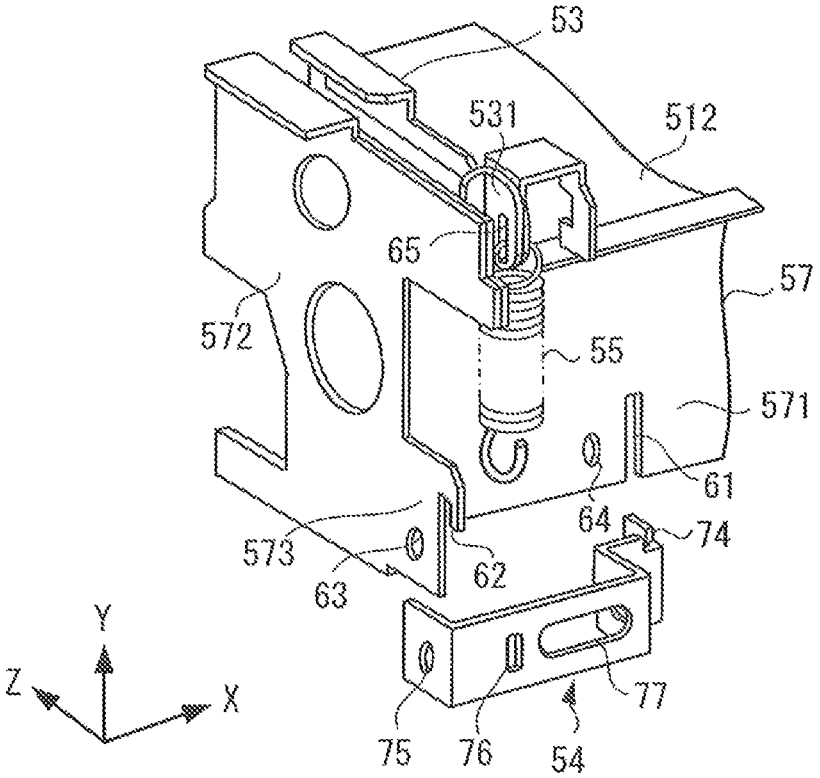
FIG. 5 is an exploded perspective view illustrating a configuration of a main part of the fixing device.
Figure 6:
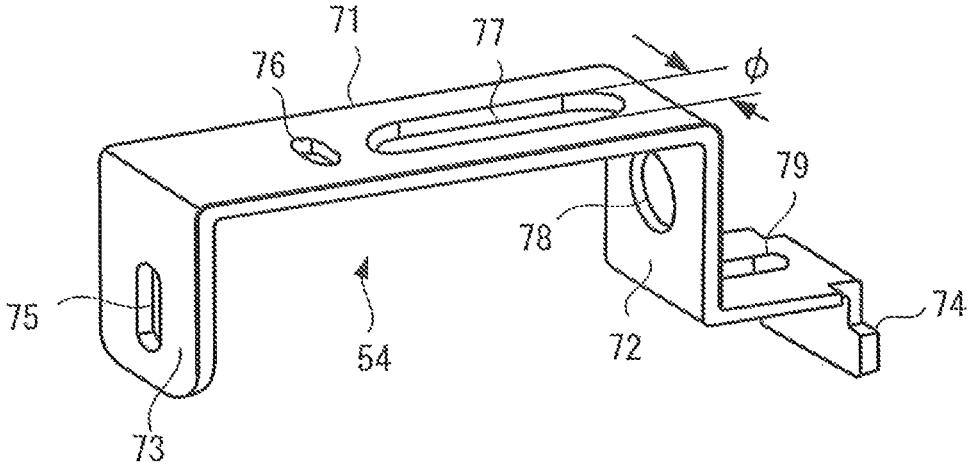
FIG. 6 is an enlarged perspective view illustrating a bracket being used.

FIG. 5 is an exploded perspective view illustrating a configuration of a main part of the fixing device in the embodiment. FIG. 5 is a view when a part illustrated by a circle E of FIG. 4, that is, a corner part of one end of the longitudinal direction X of the second supporting member 52 is seen from an arrow F direction. In addition, FIG. 6 is an enlarged perspective view illustrating the bracket 54 being used in the embodiment.

FIG. 5 illustrates a corner part of one end of the longitudinal direction X of the second supporting member 52, but the corner part of the other end thereof in the longitudinal direction has also the same configuration. However, the corner part of one end and the corner part of the other end are symmetrically configured as found from FIG. 4.

In FIG. 5, the frame 57 constituting the second supporting member 52 includes a first frame 571 extending in an X direction and a second frame 572 extending in a Z direction so as to be orthogonal to the corner part. A square hole 61 is formed in a height direction Y from a bottom surface at a position distant from a corner part of the first frame 571.

The second frame 572 includes a protrusion portion 573 which is slightly protruded to an opposite side of the depth direction Z, and forms a hook 62 on the tip end of the protrusion portion 573. In addition, a screw hole 63 is formed in the protrusion portion 573. A screw hole 64 is formed on the vicinity of the square hole 61.

The arm 53 is provided substantially parallel to the second frame 572 at the end portion 512 of one end of the longitudinal direction of the first supporting member 51. The tip end of the arm 53 is slightly further protruded than a surface of the first frame 571 of an opposite side of the depth direction Z, and is formed with a hole 65 hooking one end of the spring 55 on a protrusion portion 531.

In addition, the other end of the spring 55 is hooked to the bracket 54. The bracket 54 is a sheet metal component, four parts thereof are bent, and five surfaces are included in the bracket. That is, as enlarged and illustrated in FIG. 6, the bracket 54 includes a main body 71 formed by being bent in a U shape, and includes a hooking portion 74 extending in an L shape from the bent one end 72 of the main body 71 as a single body. In addition, the screw hole 75 is formed on the bent other end 73 of the main body 71.

Further, the hole 76 for hooking the other end of the spring 55 is included in the main body 71.

In addition, a hole, where an inserting member can be inserted in an oblique direction toward the hooking portion 74 from the other end 73, is formed in the main body 71. That is, a long hole 77 is formed in the main body 71, and a hole 78 is formed on the one end 72. As the inserting member, for example, a screwdriver for tightening a screw may be used, but another stick type inserting member may be used. A tip end portion of the screwdriver can be inserted in a direction of the hole 78 from the long hole 77, that is, in an oblique direction toward the hooking portion 74. Further, a screw hole 79 is formed on the main body 71 side of the hooking portion 74.

The bracket 54 hooks the other end of the spring 55 to the hole 76, and a tip end of the hooking portion 74 is inserted into and hooks the square hole 61 of the first frame 571. In addition, an edge in the height direction of the main body 71 on an opposite side of the hooking portion 74 is held in the hook 62 of the second frame 572, and thus the spring 55 can be fixed between the arm 53 and the bracket 54.

The hooking portion 74 of the bracket 54 is inserted to the square hole 61 formed in the frame 571, the hooking portion 74 is supported by the square hole. In addition, the hook 62 formed on the frame 572 regulates movement of the other end 73 side of the bracket 54 in which the spring 55 is mounted. The square hole 61 and the hook 62 constitute a positioning member.

Hereinafter, with reference to FIG. 7A, FIG. 7B, and FIG. 8, a mounting method of the bracket 54 in the frame 57, and a mounting method of the spring 55 between the arm 53 and the bracket 54 will be described.

Figure 7A:
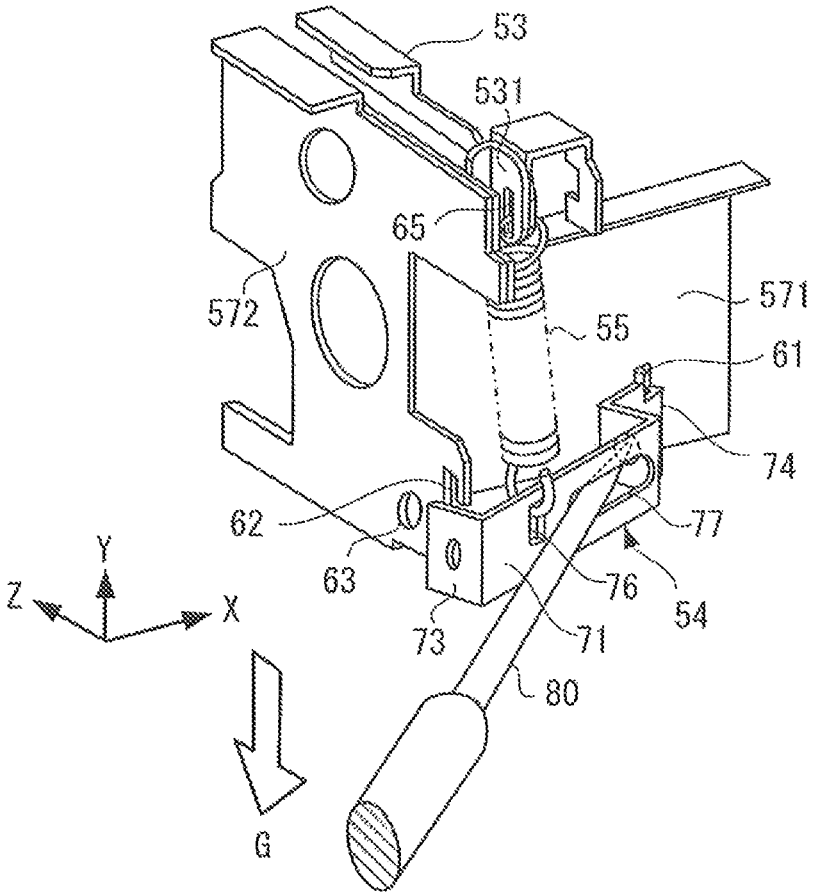
FIG. 7A is a first explanatory view illustrating a mounting method of a spring (urging portion) in the fixing device.

In FIG. 7A, first, the one end of the spring 55 hooks the hole 65 formed on the protrusion portion 531 of the arm 53. Also, the other end of the spring 55 hooks the hole 76 of the bracket 54. In the bracket 54, the other end 73 and the hooking portion 74 of the main body 71 are opposite to each other, so that the other end faces the second frame 572, and the hooking portion faces the first frame 571. Also, a tip end of the hooking portion 74 of the bracket 54 is inserted into and hooks the square hole 61 of the first frame 571.

In addition, a tip end of the screwdriver 80 is inserted toward the long hole 77 and the hole 78 of the bracket 54. That is, the tip end of the screwdriver 80 is inserted toward the hooking portion 74 from the long hole 77 in an oblique direction. Also, the other end of the screwdriver 80 is pressed down in an arrow G direction illustrated in FIG. 7A, that is, a direction against the tension of the spring 55. When the other end of the screwdriver 80 is pressed down, the bracket 54 is pressed down the hooking portion 74 as a supporting point, and the spring 55 is lengthened.

Figure 7B:
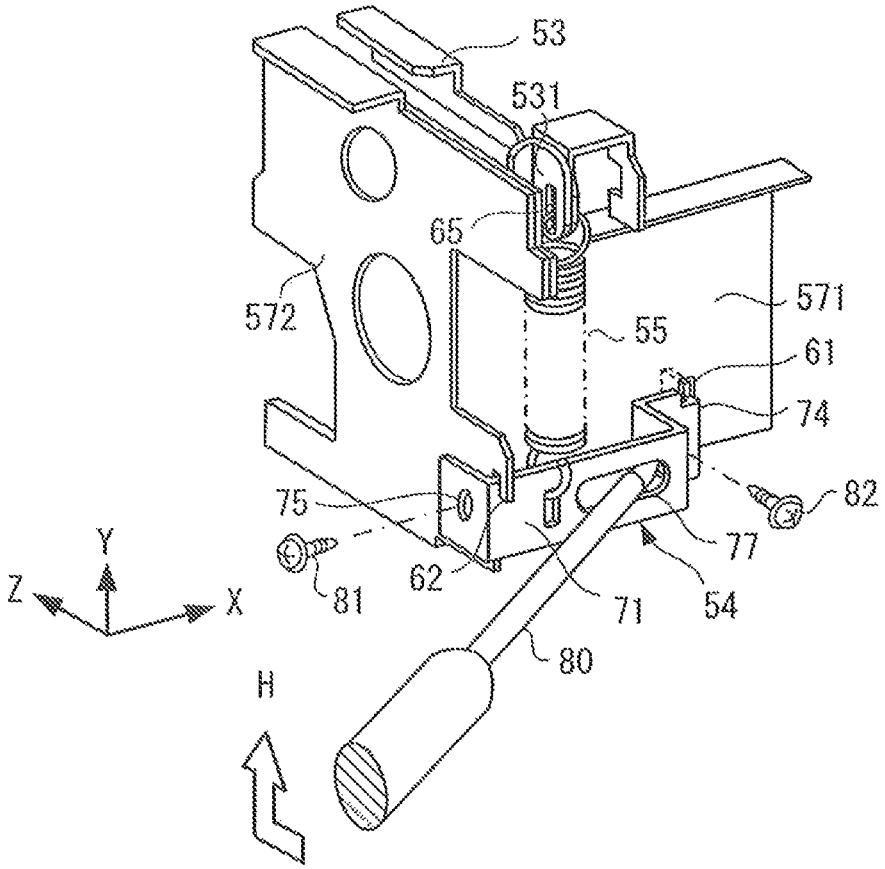
FIG. 7B is a second explanatory view illustrating a mounting method of a spring (urging portion) in the fixing device.

Next, when an upper end of the main body 71 of the bracket 54 is lowered to a position of the hook 62 formed in the second frame 572, as illustrated in an arrow H of FIG. 7B, the other end of the screwdriver 80 is moved in a direction of the second frame 572 and is moved upwardly. The bracket 54 is pulled away by the spring 55, and the upper end of the main body 71 of the bracket 54 is held in the hook 62. Therefore, even if the tip end of the screwdriver 80 is removed from the long hole 77, the bracket 54 is positioned on the frame 57 and is not released. The other end 73 of the bracket 54 faces the second frame 572.

Figures 8, 9:
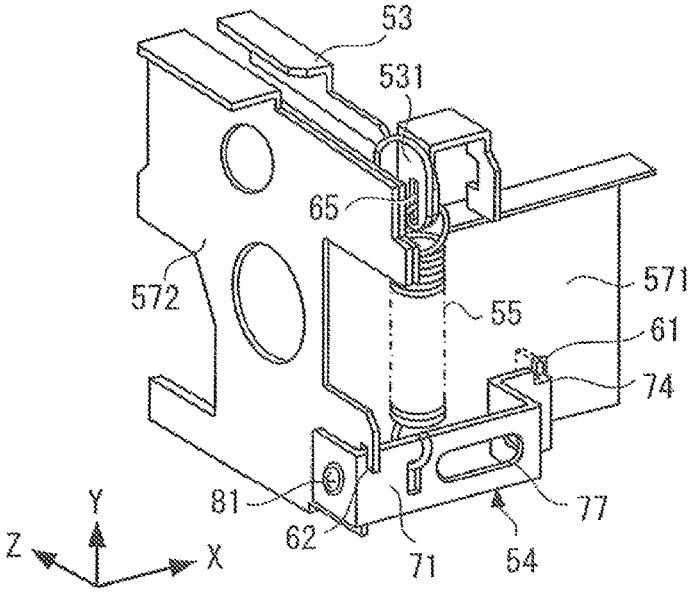
FIG. 8 is a perspective view illustrating amounting state of the spring.
FIG. 9 is an explanatory view illustrating an example of a dimension of a tip end of a screwdriver which is used for mounting the bracket.

Finally, as illustrated in FIG. 8, a screw 81 is inserted into the screw hole 75 formed in the other end 73 of the bracket 54 and the screw hole 63 formed in the second frame 572, and is tightened by the screwdriver 80. In addition, a screw 82 is inserted into the screw hole 79 (FIG. 6) formed on the one end 72 side of the bracket 54 and the screw hole 64 formed on the first frame 571, and is tightened by the screwdriver 80, thus the bracket 54 is fastened to the frame 57.

Therefore, the first supporting member 51 and the second supporting member 52 are pulled by the spring 55, and the fixing belt 41 and the pressurizing roller 43 are strongly pulled to each other with respect to the heating roller 42.

As illustrated in FIG. 7A, the tip end of the screwdriver 80 is inserted in the oblique direction from the long hole 77 of the bracket 54, and when the other end of the screwdriver 80 is pressed down, the hooking portion 74 serves as a supporting point. In addition, the long hole 77 of the bracket 54 is used as a point of action, and the other end of the screwdriver 80 is used as a point of effort. That is, using a "principle of lever", the hooking portion 74 is set to a supporting point, and the bracket 54 can be simply pressed down against the tension of the spring 55. Therefore, the bracket 54 can be easily mounted in the frame 57.

As the screwdriver 80, a Phillips-head screwdriver for tightening a commercially available screw can be used. In assembly of the MFP, a second-bit screwdriver 80 for tightening a screw having an M3 size or M4 size may be used.

The long hole 77 which passes through the tip end of the screwdriver 80 of the bracket 54 differs depending on sizes of the screws 81 and 82. For example, when a dimension of the long hole 77 of the bracket 54 is calculated on the basis of JIS-B4633 (JIS means Japan Industrial Standard), the dimension thereof (a dimension ϕ in a short direction of the long hole 77 of FIG. 6) becomes a number value illustrated in FIG. 9.

FIG. 9 is an explanatory view illustrating an example of a dimension of the tip end of the screwdriver 80 being used for mounting the bracket 54. In FIG. 9, NO.1 to NO.4 indicate bit numbers of the screwdriver 80, and M2 to M8 indicate sizes of the screw being used. In addition, dimensions of the tip ends of the screwdriver indicate shaft diameters of the tip end of the screwdriver 80, and dimensions of the long hole indicate dimensions ϕ in a short direction of the long hole 77 of the bracket 54.

As illustrated in FIG. 9, the dimension ϕ of the long hole 77 of the bracket 54 is set to be slightly greater than the dimension of the tip end of the screwdriver 80 for tightening the screw. If the dimension ϕ of the long hole 77 is too great with respect to the dimension of the tip end of the screwdriver 80, when a tip end portion of the screwdriver 80 is inserted into the long hole 77 of the bracket 54, it is not easy for the screwdriver to insert to the hole. In addition, the dimension ϕ of the long hole 77 is too small with respect to the dimension of the tip end of the screwdriver 80, the tip end portion of the screwdriver 80 cannot be inserted into the long hole of the bracket 54. Therefore, it is desirable that the dimension ϕ of the long hole 77 of the bracket 54 is set to be slightly greater than the dimension of the tip end of the screwdriver 80.

As described above, in the image forming apparatus according to the first embodiment, the bracket 54 can be simply mounted in the frame 57 against the tension of the spring 55. In addition, if the bracket 54 is mounted using a general-purpose screwdriver for tightening the screw, a special tool is not necessary.

Second Embodiment

In the embodiment described above, for urging the heating roller 42, and the fixing belt 41 and the pressurizing roller 43 so as to be pulled to each other, the bracket 54 and the spring 55 are used. However, it is not limited to the fixing device, and the bracket 54 and the spring 55 can be used for pulling the other rotation bodies to each other.

For example, since the primary transferring roller 25K and the photoconductive drum 22K are urged so as to be pulled to each other, the bracket 54 and the spring 55 may be used. In this example, the photoconductive drum 22K is rotatably supported by a first supporting member, and the primary transferring roller 25K is rotatably supported by a second supporting member. In addition, a fastening portion is formed in the first supporting member, the bracket 54 is mounted in the second supporting member, and the spring 55 of the fastening portion and the bracket 54 is mounted. Accordingly, a toner image on the photoconductive drum 22K can be primarily transferred to the intermediate transferring belt 21.

In addition, as another example, for urging the driving roller 31 and the secondary transferring roller 33 so as to be pulled to each other as illustrated in FIG. 1, the bracket 54 and the spring 55 may be used. In this example, the driving roller 31 is rotatably supported by the first supporting member, the secondary transferring roller 33 is rotatably supported by the second supporting member. In addition, the fastening portion is formed in the first supporting member, the bracket 54 is mounted in the second supporting member, and the spring 55 of the fastening portion and the bracket 54 is mounted. Accordingly, when the paper S passes between the driving roller 31 and the secondary transferring roller 33, an image can be secondary transferred to the paper S.

In addition, in order to pull a pair of the paper discharge rollers 37 to each other, the bracket 54 and the spring 55 may be used.

Further, as the urging portion, the coil spring 55 has been described as an example, but instead of the coil spring 55, a hard rubber, and the like having strong tension can be used as the urging portion.

As described above, in the image forming apparatus according to the embodiment, using the "principle of lever", the bracket 54 can be simply mounted in the frame 57 against the tension of the urging portion 55. In addition, if the screwdriver being used for tightening the screw is used, it is not necessary to use a special tool in order to mount the bracket 54.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a first rotator;

a second rotator that faces the first rotator;

a first supporting member that rotatably supports the first rotator;

a second supporting member that rotatably supports the second rotator;

a bracket that is mounted in the second supporting member distant from a fastening portion of the first supporting member, includes a main body portion and a hooking portion formed on one end side of the main body portion, and is formed with a hole to which an inserting member is able to be inserted in an oblique direction from the other end side of the main body portion toward the hooking portion;

an urging portion that is disposed between the fastening portion and the bracket, and urges the first rotator and the second rotator so as to be pulled to each other; and a positioning member that is formed in the second supporting member, supports the hooking portion of the bracket, and regulates movement of the other end side of the bracket on which the urging portion is mounted, wherein the second supporting member includes a frame for mounting the bracket, and wherein the positioning member is formed by forming a square hole which supports the hooking portion of the bracket in a state of being inserted into a hole in the frame, and forming a hook which regulates the movement of the other end side of the bracket on which the urging portion is mounted wherein the bracket is mounted so that the hooking portion serves as a supporting point at the square hole, wherein one end of the inserting member is inserted into the hole formed in the main body portion and the bracket is used as a point of action, and wherein the bracket is moved in a direction against tension of the urging portion using the other end of the inserting member as a point of effort, and the other end side of the main body portion is held in the hook.

2. The apparatus according to claim 1, wherein a tip end portion of a screwdriver as the inserting member is able to be inserted into the hole of the bracket, and the hole is formed to be larger than a shaft diameter of the tip end portion of the screwdriver.

3. The apparatus according to claim 1, wherein the bracket is formed with the main body portion which is bent in a U shape, and includes the hooking portion continued from the bent end portion of the main body portion as a single body, wherein a first hole is formed in the main body portion in a longitudinal direction, and a second hole is formed at the bent end portion of the main body portion, and wherein the inserting member is able to be inserted from the first hole toward the second hole.

4. The apparatus according to claim 1, wherein the first rotator includes a fixing belt which is a rotatable tubular shape and a pressurizing roller where the fixing belt is stretched in an image forming portion, and the second rotator is a heating roller which is disposed so as to face the pressurizing roller, wherein the pressurizing roller and the heating roller are urged so as to be pulled to each other by a coil spring, and wherein a recording medium is transported by being pinched between the fixing belt and the heating roller, and a toner image is fixed to the recording medium.

5. The apparatus according to claim 1, wherein the first rotator is a photoconductive drum in the image forming portion, and the second rotator is a primary transferring roller which is disposed so as to face the photoconductive drum, wherein the photoconductive drum and the primary transferring roller are urged so as to be pulled to each other by the coil spring, and wherein an intermediate transferring belt is circularly moved by being pinched between the photoconductive drum and the primary transferring roller, and a toner image on the photoconductive drum is primarily transferred to the intermediate transferring belt.

6. The apparatus according to claim 1, wherein the first rotator is a driving roller which drives the intermediate transferring belt in the image forming portion, and the second rotator is a secondary transferring roller which is disposed so as to face the driving roller, wherein the driving roller and the secondary transferring roller are urged so as to be pulled to each other by the coil spring, and wherein the recording medium is transported between the driving roller and the secondary transferring roller, and a toner image on the intermediate transferring belt is secondarily transferred to the recording medium.

7. A fixing device comprising:

a fixing belt of a rotatable tubular shape that heats a toner image formed on a recording medium;

a heating roller that is disposed so as to face the fixing belt along a shaft direction thereof and transports the recording medium by being rotated with the fixing belt;

a pressurizing roller that is disposed in the fixing belt, and pressurizes the fixing belt in a direction of the heating roller;

a first supporting member that rotatably supports a first rotator including the fixing belt and the pressurizing roller;

a second supporting member that rotatably supports the heating roller;

a bracket that is mounted in the second supporting member distant from a fastening portion formed in the first supporting member, includes a main body portion and a hooking portion formed on one end side of the main body portion, and is formed with a hole where an inserting member is able to be inserted in an oblique direction from the other end side of the main body portion toward the hooking portion;

an urging portion that is disposed between the fastening portion and the bracket, and urges the first rotator and the heating roller so as to be pulled to each other; and a positioning member that is formed in the second supporting member, supports the hooking portion of the bracket, and regulates movement of the other end side of the bracket on which the urging portion is mounted, wherein the second supporting member includes a frame for mounting the bracket, wherein the positioning member is formed by forming a square hole which supports the hooking portion of the bracket in a state of being inserted into the hole in the frame, and forming a hook which regulates the movement of the other end side of the bracket on which the urging portion is mounted, wherein the bracket is mounted so that the hooking portion serves as a supporting point at the square hole, wherein one end of the inserting member is inserted into the hole formed in the main body portion and the bracket is used as a point of action, and wherein the bracket is moved in a direction against tension of the urging portion using the other end of the inserting member as a point of effort, and the other end side of the main body portion is held in the hook.

* * * * *